US006039120A

United States Patent [19]

Wilkins et al.

[11] Patent Number: 6,039,120

[45] Date of Patent: Mar. 21, 2000

[54] ADJUSTABLE ISOLATION SLEEVE

[75] Inventors: Robert Lee Wilkins; Peter Moles, both of Houston, Tex.

[73] Assignee: Kvaerner Oilfield Products, Houston, Tex.

[21] Appl. No.: 09/002,017

[22] Filed: Dec. 31, 1997

[51] Int. Cl.[7] ..... E21B 7/12

[52] U.S. Cl. ..... 166/368; 166/348; 166/242.1; 285/355; 285/390; 285/32

[58] Field of Search ..... 166/368, 348, 166/242.1, 88.1, 85.3; 285/355, 390, 32

[56] References Cited

U.S. PATENT DOCUMENTS

| | | | |
|---|---|---|---|
| 3,739,846 | 6/1973 | Beson | 166/89 |
| 3,870,101 | 3/1975 | Helmus | 166/363 |
| 3,965,977 | 6/1976 | Beson | 166/88 |
| 3,971,576 | 7/1976 | Herd et al. | 285/87 |
| 4,703,774 | 11/1987 | Seehausen | 137/614 |
| 4,709,725 | 12/1987 | Morrison | 137/614 |
| 4,796,922 | 1/1989 | Prichard | 285/26 |
| 4,852,611 | 8/1989 | Knerr et al. | 137/595 |
| 4,898,201 | 2/1990 | Conley et al. | 137/245.5 |
| 5,003,821 | 4/1991 | Rivero-Olmedo | 73/201 |
| 5,687,999 | 11/1997 | Lancry et al. | 285/333 |

FOREIGN PATENT DOCUMENTS

| | | |
|---|---|---|
| 2097885 | 11/1982 | United Kingdom . |
| 2132728 | 7/1984 | United Kingdom . |
| 2184508 | 6/1987 | United Kingdom . |
| 2195158 | 3/1988 | United Kingdom . |

*Primary Examiner*—David Bagnell
*Assistant Examiner*—Chi H. Kang
*Attorney, Agent, or Firm*—Wendy Buskop; Bayko Gibson et al.

[57] ABSTRACT

An apparatus for use in subsea well completion systems is provided. The apparatus has an isolation sleeve and an extension sleeve. The isolation sleeve has a first end, a second end and a longitudinal axis defined between the first end and the second end. The isolation sleeve has a generally tubular shape. The extension sleeve has a first end attached to the second end of the isolation sleeve to form an assembly comprising the isolation sleeve and the extension sleeve, a second end, and a longitudinal axis that is coaxially aligned with the longitudinal axis of the isolation sleeve. Like the isolation sleeve, the extension sleeve has a generally tubular shape.

12 Claims, 3 Drawing Sheets

ADJUSTABLE ISOLATION SLEEVE

BACKGROUND OF THE INVENTION

The present invention relates to an adjustable isolation sleeve that can be used as a retrofit for existing well completion systems.

Well completion systems include a wellhead, a tree block sometimes called a spool body, and a tubing hanger landed in the spool body. Inside valve through bore systems, the spool body defines a vertical bore extending therethrough and has a horizontal production outlet in flow communication with the vertical bore. The spool body has annular sealing profiles that accommodate annular gaskets at both the top and bottom connections. At the lower sealing connection, a parallel sealing diameter is provided for an isolation sleeve.

The spool body is mounted on the wellhead and has the tubing hanger landed within its vertical bore. The spool body typically has an isolation sleeve attached to the lower end inside the vertical bore. The main function is to seal off against the casing hanger. With the tree landed on the wellhead, the isolation sleeve isolates the annulus from the annular gasket. A test port can be provided to test the interspace between the isolation sleeve and the annular gasket.

The isolation sleeve may also act as an orientation sleeve for the tubing hanger. Orientation can be provided by a helical profile and slot machined into the inside surface of the isolation sleeve. In the alternative, a helix having a slot can be attached to the spool body and positioned inside the isolation sleeve.

In order to properly mate an isolation sleeve with an existing well completion system, the isolation sleeve is required to be a defined length. If the casing hanger height as it is found in the field, is not as per the specifications, traditionally a new isolation sleeve will need to be forged and machined. An isolation sleeve that is adjustable in length allows the operator to adjust the isolation sleeve to the required length in the field, to forego the time and expense of forging and manufacturing a new isolation sleeve.

OBJECTS OF THE INVENTION

It is an object of the present invention to provide an isolation sleeve that can be easily adjusted in length.

It is another object of the present invention to provide an isolation sleeve that can be retrofitted into a variety of wellheads.

SUMMARY OF THE INVENTION

An apparatus for use in subsea well completion systems is provided. The apparatus has an isolation sleeve and an extension sleeve. The isolation sleeve and extension sleeve are typically used for sealing off the spool body from the casing hanger. The isolation sleeve has a first end, a second end and a longitudinal axis defined between the first end and the second end. The isolation sleeve has a generally tubular shape. The extension sleeve has a first end attached to the second end of the isolation sleeve to form an assembly comprising the isolation sleeve and the extension sleeve, a second end, and a longitudinal axis that is coaxially aligned with the longitudinal axis of the isolation sleeve. Like the isolation sleeve, the extension sleeve has a generally tubular shape.

DETAILED DESCRIPTION OF THE PREFERRED EMBODIMENTS

Figure 1:
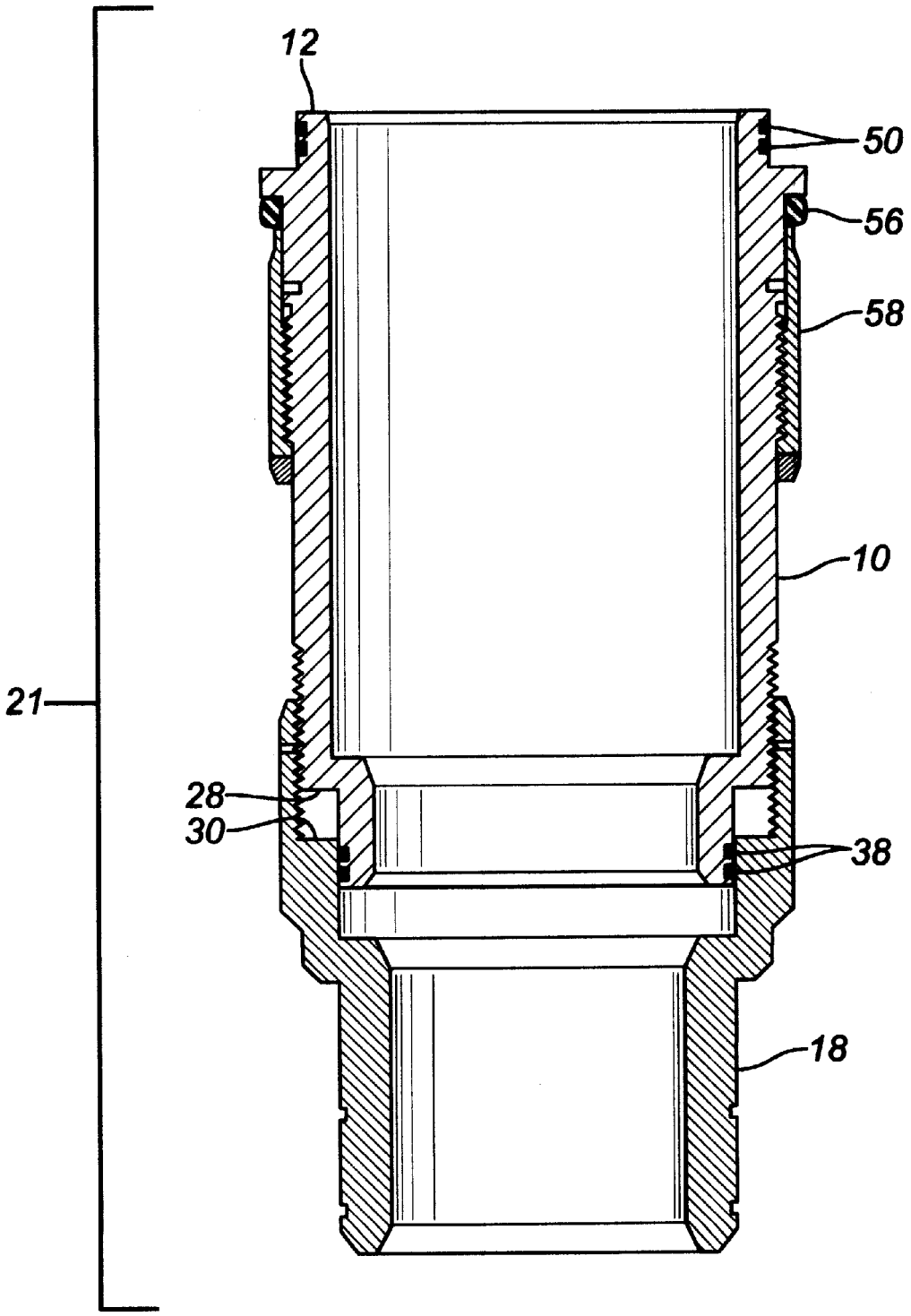
FIG. 1 is a cross-sectional view of one embodiment of the present invention.
Figure 2:
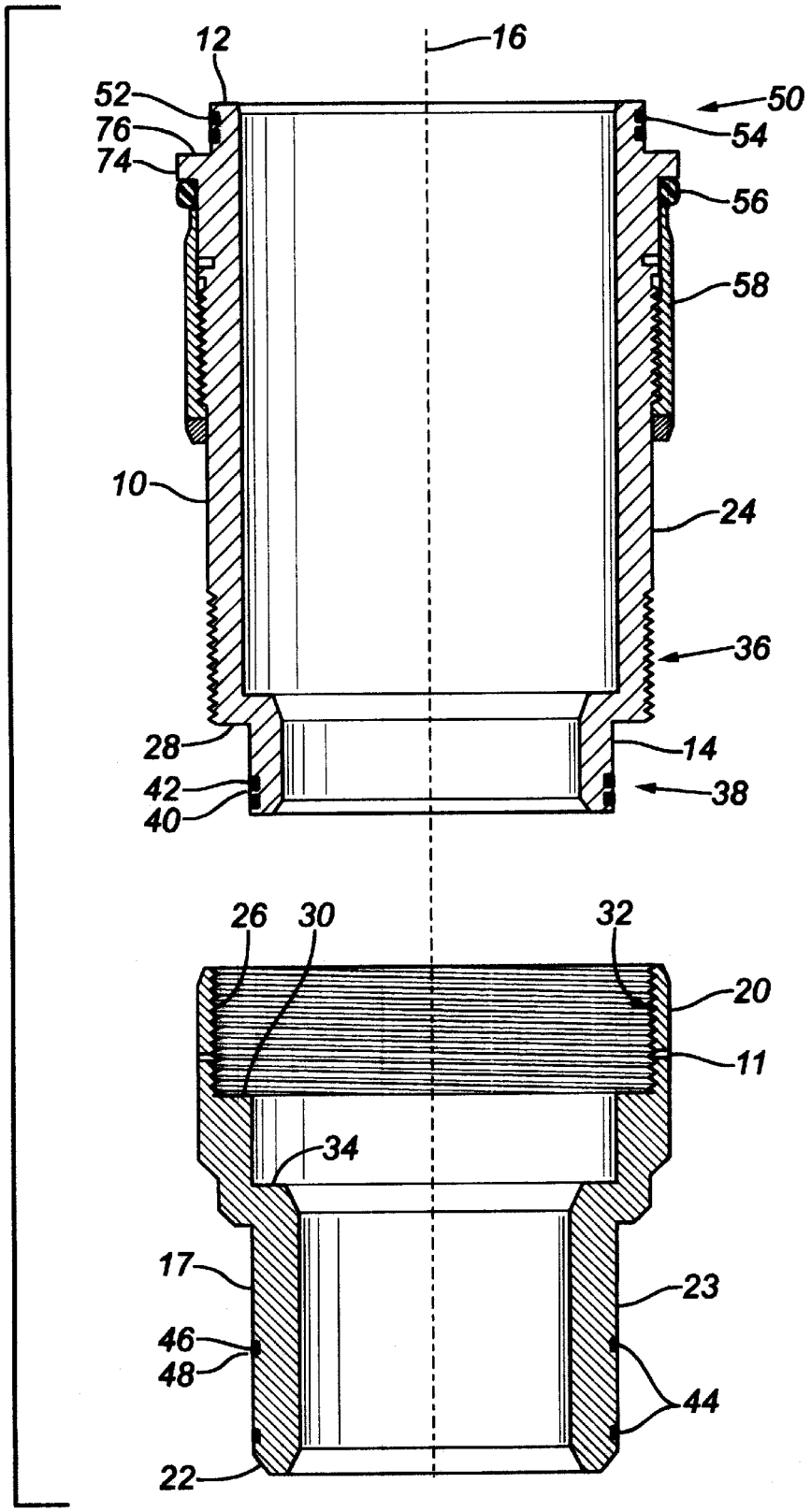
FIG. 2 is a cross-sectional view of one embodiment showing the isolation sleeve separated from the extension sleeve.

One embodiment of the present invention there is provided an apparatus for use in subsea well completion systems. As shown in FIG. 1, the apparatus has an isolation sleeve 10 and an extension sleeve 18. The isolation sleeve 10 has a first end 12, a second end 14 and a longitudinal axis 16 defined between the first end 12 and the second end 14. The sleeve 10 has a generally tubular shape. The extension sleeve 18 has a first end 20 attached to the second end 14 of the isolation sleeve 10 to form an assembly 21 comprising the isolation sleeve 10 and the extension sleeve 18, a second end 22, and a longitudinal axis 16 that is coaxially aligned with the longitudinal axis 16 of the isolation sleeve 10. (FIG. 2) Like the isolation sleeve 10, the extension sleeve 18 has a generally tubular shape.

The isolation sleeve 10 has an outer surface 24 defining an outer diameter and the extension sleeve 18 has an inside surface 26 defining an inner diameter. The inside surface 26 of the extension sleeve 18 is sized to closely receive the second end 14 of the isolation sleeve 10. The outer surface 24 of the isolation sleeve 10 near the second end 14 forms an annular wall portion 28 facing the second end 14. The inside surface 26 of the extension sleeve 18 forms a first annular shoulder portion 30 facing the first end 20 of the extension sleeve 18.

The inside surface 26 of the extension sleeve 18 forms a second annular shoulder portion 34 facing the first end 20, where the second annular shoulder portion 34 is positioned between the first annular shoulder portion 30 and the second end 22 of the extension sleeve 18.

Preferably, the outer surface 24 of the isolation sleeve 10 defines threads 36 therein positioned between the annular wall portion 28 and the first end 12 for threadably engaging the threads on the extension sleeve, so that the assembly 21 is adjustable in length between the first end 12 of the isolation sleeve 10 and the second end 22 of the extension sleeve 18. Once the desired length is attained, a pair of set screws 11 are engaged to prevent the isolation sleeve from unthreading from the extension sleeve.

In order to seal the isolation sleeve 10 within the well completion system, a series of seal means can be provided. It is preferred that the outer surface 24 of the isolation sleeve 10 includes a first seal means 38 near the second end 14 for sealably engaging the inside surface 26 of the extension sleeve 18. The first seal means 38 can be at least one annular groove 40 formed in the outer surface 24 of the isolation sleeve 10 and at least one elastomeric seal means 42 such as an O-ring positioned in the at least one annular groove 40. Likewise, it is preferred that the outer surface 23 of the extension sleeve 18 includes a seal means 44 near the second end 22 for sealably engaging the inside surface of a casing hanger. The seal means 44 can be at least one annular groove 46 formed in the outer surface 23 of the extension sleeve 18 and at least one elastomeric seal means 48 positioned in the at least one annular groove 46. Additionally, the outer surface 24 of the isolation sleeve 10 includes a second seal means 50 near the first end 12 for sealably engaging a spool body. Again, the second seal means 50 can be at least one annular groove 52 formed in the outer surface 24 of the isolation sleeve 10 and at least one elastomeric seal means 54 positioned in the at least one annular groove 52.

In use, the annular wall portion 28 of the isolation sleeve 10 abuts the first annular shoulder 30 of the extension sleeve 18 when the extension sleeve 18 is in a fully retracted position. The annular wall portion 28 on the isolation sleeve 10 can be in a spaced apart relationship with the first annular shoulder when the isolation sleeve 10 is in a second position.

The isolation sleeve 10 is mounted onto the inside surface 26 of the spool body with a split lock ring 56, and a retainer ring 58. When the sleeve is positioned inside the spool body, the retainer ring 58 slides in an upward direction and drives the lock ring 56 into an engaged position.

In a preferred embodiment, there is provided, a spool body 60 having an upper end 62, a lower end 64, an inside surface 66 defining a vertical bore 68 extending therethrough, and a longitudinal axis 70 extending between the upper end 62 and the lower end 64. The first end 12 of the isolation sleeve 10 is positioned within the vertical bore defined by the spool body 60 near the lower end, so that the outer surface 24 of the isolation sleeve 10 is sealingly engaged with the inside surface 66 defined by the spool body.

Preferably, the spool body 60 defines an annular shoulder 72 facing the lower end 64 of the spool body 60. The first end 12 of the isolation sleeve 10 forms an annular flange 74 having a face facing the first end 12, so that the annular shoulder 72 of the spool body 60 is closely received by the face 76 of the annular flange 74 when the isolation sleeve 10 is completely installed in the spool body 60.

Figure 3:
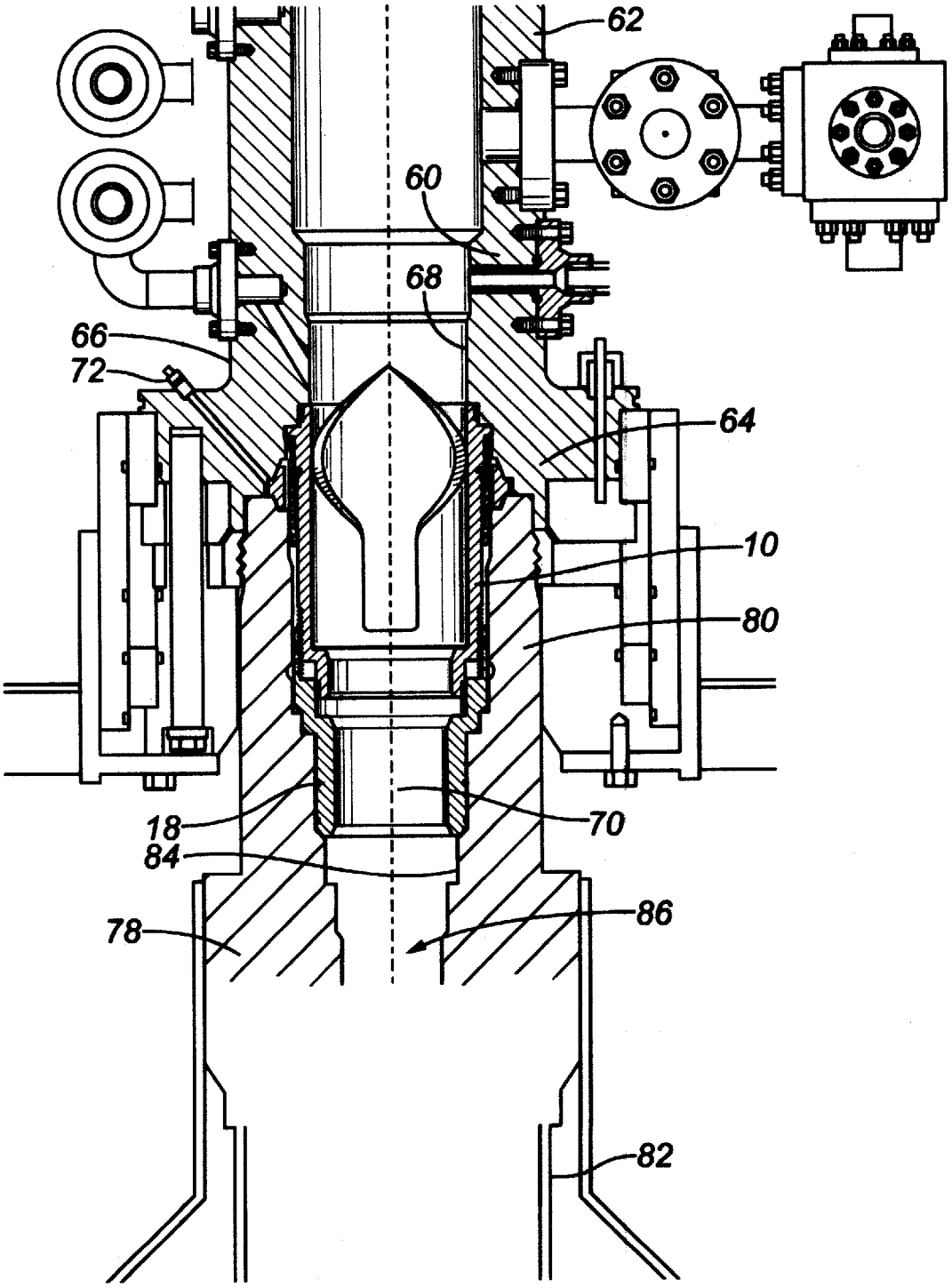
FIG. 3 is a perspective view of one embodiment of the invention.

Preferably, there is provided a wellhead 78 having an upper end 80, a lower end 82, and an inside surface 84 defining a vertical bore 86 extending therethrough. (FIG. 3) The lower end 64 of the spool body 60 is attached to the upper end 80 of the wellhead so that the second end 14 of the extension sleeve 18 extends down into the vertical bore defined by the wellhead. A casing hanger having an upper end, an outside surface, and an inside surface defining a vertical bore extending therethrough can also be provided. The inside surface of the casing hanger is sized to closely receive the outside surface of the extension sleeve 18 and the outside surface is attached to the inside surface of the wellhead.

What is claimed is:

1. An apparatus comprising:

an isolation sleeve having a first end, a second end and a longitudinal axis defined between said first end and said second end, said isolation sleeve having a generally tubular shape;

an extension sleeve having a first end attached to the second end of the isolation sleeve to form an assembly comprising the isolation sleeve and the extension sleeve, a second end, and a longitudinal axis is that is coaxially aligned with the longitudinal axis of the isolation sleeve, said extension sleeve having a generally tubular shape;

wherein the isolation sleeve has an outer surface defining an outer diameter and said extension sleeve has an inner surface defining an inner diameter, wherein said inner surface of said extension sleeve is sized to closely receive the second end of the isolation sleeve;

wherein the outer surface of the isolation sleeve near the second end forms an annular wall portion facing the second end;

wherein the inside surface of the extension sleeve forms a first annular shoulder portion facing the first end of the extension sleeve, said inside surface further defining threads therein positioned between the first end and the annular shoulder portion;

wherein the inside surface of the extension sleeve forms a second annular shoulder portion facing the first end, said second annular shoulder portion being positioned between the first annular shoulder portion and the second end of the extension sleeve; and wherein the outer surface of the isolation sleeve defines threads therein positioned between the annular wall portion and the first end for threadably engaging the threads on the extension sleeve, so that the assembly is adjustable in length between the first end of the isolation sleeve and the second end of the extension sleeve.

2. An apparatus as in claim 1, wherein the outer surface of the isolation sleeve further comprises a seal means, near the second end, for sealably engaging the inside surface of the extension sleeve.

3. An apparatus as in claim 2, wherein the seal means comprises at least one annular groove formed in the outer surface of the isolation sleeve and at least one elastomeric seal means positioned in the at least one annular groove.

4. An apparatus as in claim 1, wherein the outer surface of the extension sleeve further comprises a seal means, near the second end, for sealably engaging a casing hanger.

5. An apparatus as in claim 4, wherein the seal means comprises at least one annular groove formed in the outer surface of the extension sleeve and at least one elastomeric seal means positioned in the at least one annular groove.

6. An apparatus as in claim 1, wherein the outer surface of the isolation sleeve further comprises a seal means near the first end for sealably engaging a spool body.

7. An apparatus as in claim 6, wherein the seal means comprises at least one annular groove formed in the outer surface of the isolation sleeve and at least one elastomeric seal means positioned in the at least one annular groove.

8. An apparatus as in claim 1, wherein the annular wall portion of the isolation sleeve abuts the first annular shoulder of the extension sleeve when the extension sleeve is in a fully retracted position.

9. An apparatus as in claim 1, further comprising a spool body having an upper end, a lower end, an inside surface defining a vertical bore extending therethrough, and a longitudinal axis extending between said upper end and said lower end, wherein the first end of the isolation sleeve is positioned within the vertical bore defined by the spool body near the lower end, so that the outer surface of the isolation sleeve is sealingly engaged with the bore defined by the spool body.

10. An apparatus as in claim 9, wherein the spool body defines an annular shoulder facing the lower end and the first end of the isolation sleeve forms an annular flange having a face facing the first end, wherein said annular shoulder is closely received by the face when the isolation sleeve is installed in the spool body.

11. An apparatus as in claim 9, further comprising a wellhead having an upper end, a lower end, and an inside surface defining a vertical bore extending therethrough, wherein the lower end of the spool body is attached to the upper end of the wellhead so that the second end of the isolation sleeve extends down into the vertical bore defined by the wellhead.

12. An apparatus as in claim 11, further comprising a casing hanger having an upper end, an outside surface, and an inside surface defining a vertical bore extending therethrough, wherein the inside surface of the casing hanger is sized to closely receive the outside surface of the extension sleeve and the outside surface is attached to the inside surface of the wellhead.

* * * * *